US008332064B2

(12) United States Patent
Torikoshi et al.

(10) Patent No.: US 8,332,064 B2
(45) Date of Patent: Dec. 11, 2012

(54) POLISHING METHOD AND POLISHING APPARATUS, AND PROGRAM FOR CONTROLLING POLISHING APPARATUS

(75) Inventors: Tsuneo Torikoshi, Tokyo (JP); Kuniaki Yamaguchi, Kumamoto (JP)

(73) Assignee: Ebara Corporation, Tokyo (JP)

( * ) Notice: Subject to any disclaimer, the term of this patent is extended or adjusted under 35 U.S.C. 154(b) by 1003 days.

(21) Appl. No.: 11/991,064

(22) PCT Filed: Sep. 12, 2006

(86) PCT No.: PCT/JP2006/318461

§ 371 (c)(1),
(2), (4) Date: Feb. 27, 2008

(87) PCT Pub. No.: WO2007/032519

PCT Pub. Date: Mar. 22, 2007

(65) Prior Publication Data

US 2009/0264052 A1 Oct. 22, 2009

(30) Foreign Application Priority Data

Sep. 16, 2005 (JP) ..... 2005-269843

(51) Int. Cl.
*G06F 19/00* (2006.01)
*G05B 13/02* (2006.01)

(52) U.S. Cl. ..... 700/121; 700/108; 700/164; 451/36; 451/41; 451/289; 451/5

(58) Field of Classification Search ..... 700/121, 700/164, 108; 451/36, 41, 64, 287; 438/424
See application file for complete search history.

(56) References Cited

U.S. PATENT DOCUMENTS

| | | | | |
|---|---|---|---|---|
| 6,102,778 | A * | 8/2000 | Morita | 451/41 |
| 6,733,368 | B1 * | 5/2004 | Pan et al. | 451/36 |
| 7,822,500 | B2 * | 10/2010 | Kobayashi et al. | 700/108 |
| 2001/0029150 | A1 * | 10/2001 | Kimura et al. | 451/41 |
| 2004/0166783 | A1 * | 8/2004 | Kimura et al. | 451/41 |
| 2005/0142991 | A1 * | 6/2005 | Nakao et al. | 451/64 |

FOREIGN PATENT DOCUMENTS

| | | |
|---|---|---|
| JP | 08-050956 | 2/1996 |
| JP | 09-155732 | 6/1997 |

(Continued)

OTHER PUBLICATIONS

International Search Report mailed Dec. 26, 2006 for International Application No. PCT/JP2006/318461.

*Primary Examiner* — Albert Decady
*Assistant Examiner* — Douglas Lee
(74) *Attorney, Agent, or Firm* — Wenderoth, Lind & Ponack, L.L.P.

(57) ABSTRACT

A polishing method can bring a polishing surface to the optimum condition for polishing, without using a dummy wafer, before resuming polishing, thereby eliminating the cost of dummy wafer. The polishing method includes carrying out a stand-by operation during a polishing-resting time period, carrying out a preparatory process to polishing, after completion of the stand-by operation, by dressing a polishing surface while supplying a polishing liquid to the polishing surface, and starting polishing of a workpiece after completion of the preparatory process to polishing. A determination as to whether to carry out the preparatory process to polishing after completion of the stand-by operation may be made based on the total operating time of the stand-by operation or the total effective number of the stand-by operations.

11 Claims, 6 Drawing Sheets

FOREIGN PATENT DOCUMENTS

| | | |
|---|---|---|
| JP | 09-168964 | 6/1997 |
| JP | 11-163101 | 6/1999 |
| JP | 11-294503 | 10/1999 |
| JP | 2000-153445 | 6/2000 |
| JP | 2003-117816 | 4/2003 |
| JP | 2003-117823 | 4/2003 |

* cited by examiner

POLISHING METHOD AND POLISHING APPARATUS, AND PROGRAM FOR CONTROLLING POLISHING APPARATUS

TECHNICAL FIELD

The present invention relates to a polishing method and a polishing apparatus for polishing and flattening a surface of a substrate (workpiece), such as a semiconductor wafer, and also to a program for controlling a polishing apparatus.

BACKGROUND ART

In a semiconductor device manufacturing process, management of substrates, such as semiconductor wafers, is usually practiced on a lot basis. For example, when polishing a semiconductor wafer by a polishing apparatus, a plurality of semiconductor wafers (one lot) are housed in a cassette and the cassette is loaded into the polishing apparatus to carry out polishing of the respective wafers.

A semiconductor device is generally manufactured through a plurality of process steps. Thus, in association with the overall process management, a polishing apparatus is not loaded with substrates such as semiconductor wafers for a period of time. During that period, the polishing apparatus enters into the state of idling operation (stand-by operation) in preparation for the next polishing operation. It is a common practice in the time of such idling to supply pure water to a polishing pad (polishing cloth), attached to a polishing table, so as to prevent drying of a surface (polishing surface) of the polishing pad.

SUMMARY OF THE INVENTION

Polishing of substrates, such as semiconductor wafers, is resumed after the idling when a cassette housing substrates therein is loaded into the polishing apparatus. The temperature of the surface (polishing surface) of the polishing pad after idling is lowered because of the supply of pure water and no practice of polishing. If polishing is carried out at such a lowered temperature, the polishing rate will be low. Further, some polishing slurries are water-repellent with its physical properties. When such a water-repellent slurry is used, it is necessary to wet the polishing pad with the slurry after idling and before the resumption of polishing. It is therefore a general practice to carry out, in advance of actual polishing of substrates such as semiconductor wafers, polishing of several dummy wafers (non-product wafers) with the polishing apparatus while supplying a slurry to the polishing surface of the polishing apparatus so as to bring the surface of the polishing pad to a desired temperature and wet the polishing pad with the slurry, thereby bringing the polishing pad to the optimum condition for polishing.

Such dummy wafers are consumables, however, and about five dummy wafers can be consumed after every idling operation of a polishing apparatus before resuming polishing of substrates. The cost of dummy wafers is thus a problem. Furthermore, it is necessary to provide for a cassette for dummy wafers and to secure a space for loading of the cassette in a polishing apparatus. This precludes a reduction in the footprint of polishing apparatus.

A top ring, provided in a polishing apparatus to hold a substrate such as a semiconductor wafer, is known which includes a plurality of independent pressure chambers against the substrate. Each pressure chamber is generally provided with an elastic body, such as a rubber. The pressure chamber can be pressurized by supplying a gas into the chamber so as to expand and contract the elastic body, thereby pressing on a substrate. Such a top ring has the drawback that the elastic body becomes hardened (deteriorated) with time after long-term use of the top ring, resulting in less expansion and contraction of the elastic body upon pressurizing the pressure chamber by internally applying a predetermined gas pressure to the pressure chamber.

A surface (polishing surface) of a polishing pad has a certain roughness for polishing of a surface of a substrate, such as a semiconductor wafer. The surface roughness, however, decreases with long-term use of the polishing pad, and the certain surface roughness may not be restored even when carrying out dressing of the surface of the polishing pad. Such a polishing pad needs to be replaced with a new one before it is used up.

The present invention has been made in view of the above situation in the background art. It is therefore an object of the present invention to provide a polishing method, a polishing apparatus and a program for controlling a polishing apparatus, which can bring a polishing surface to the optimum condition for polishing, without using a dummy wafer or the like, before resuming polishing, thereby eliminating the cost of dummy wafer or the like.

In order to achieve the object, the present invention provides a polishing method comprising: carrying out a stand-by operation during a polishing-resting time period; carrying out a preparatory process to polishing, after completion of the stand-by operation, by dressing a polishing surface while supplying a polishing liquid to the polishing surface; and starting polishing of a workpiece after completion of the preparatory process to polishing.

By carrying out, after the completion of stand-by operation, a preparatory process to polishing by dressing a polishing surface while supplying a polishing liquid to the polishing surface, it becomes possible to bring the polishing surface to a desired temperature and wet the polishing surface with the polishing liquid (slurry), thereby bringing the polishing surface to the optimum condition for polishing, without using a dummy wafer or the like. The dressing herein refers to a process as carried out for dressing of a polishing surface and cleaning of a polishing pad or the like having the polishing surface. A dressing process is generally carried out, after polishing of a substrate and before starting polishing of the next substrate, by pressing a dresser against a polishing surface while moving them relative to each other and supplying pure water to the polishing surface.

Preferably, pure water is supplied to the polishing surface during the stand-by operation.

This can present drying of the polishing surface during the stand-by operation.

In a preferred aspect of the present invention, a decision as to whether or not to carry out the preparatory process to polishing after completion of the stand-by operation is made based on the total operating time of the stand-by operation or the total effective number of the stand-by operations.

This makes it possible to carry out the preparatory process to polishing only when it is needed.

Preferably, dressing of the polishing surface is carried out during the stand-by operation.

The time of dressing of the polishing surface can be lengthened by carrying out dressing of the polishing surface during the stand-by operation. This enables sufficient dressing of the polishing surface, thereby extending the life of a polishing pad or the like having the polishing surface.

In a preferred aspect of the present invention, a pressure chamber of a top ring, which is to press the workpiece against the polishing surface by an elastic body, is internally pressurized during the stand-by operation.

The elastic body is forcibly contracted/expanded by pressuring the pressure chamber of the top ring during the stand-by operation. This can prevent the elastic body from becoming hardened (deteriorated) with time, thus preventing shortage of contraction/expansion of the elastic body.

The present invention also provides a polishing apparatus comprising: a polishing table having a polishing surface; a top ring for holding a workpiece and pressing the workpiece against the polishing surface; a dresser for dressing the polishing surface; a polishing liquid supply nozzle for supplying a polishing liquid to the polishing surface; and a control section for controlling the polishing table, the polishing liquid supply nozzle and the dresser in such a manner as to carry out a preparatory process to polishing, after completion of a stand-by operation during a polishing-resting time period, by dressing the polishing surface while supplying the polishing liquid to the polishing surface.

In a preferred aspect of the present invention, the control section makes a decision as to whether or not to carry out the preparatory process to polishing based on the total operating time of the stand-by operation or the total effective number of the stand-by operations.

The present invention also provides a program for controlling a polishing apparatus to perform operation of: carrying out a stand-by operation during a polishing-resting time period; carrying out a preparatory process to polishing, after completion of the stand-by operation, by dressing a polishing surface while supplying a polishing liquid to the polishing surface, and starting polishing of a workpiece after completion of the preparatory process to polishing.

In a preferred aspect of the present invention, the program for controlling a polishing apparatus makes a decision as to whether or not to carry out the preparatory process to polishing after completion of the stand-by operation based on the total operating time of the stand-by operation or the total effective number of the stand-by operations.

In a preferred aspect of the present invention, the program for controlling a polishing apparatus makes a decision as to whether or not to carry out dressing of the polishing surface during the stand-by operation based on the cumulative time of use of the polishing surface.

In a preferred aspect of the present invention, the program for controlling a polishing apparatus makes a decision as to whether or not to pressurize, during the stand-by operation, a pressure chamber of a top ring, which is to press the workpiece against the polishing surface by an elastic body, based on the cumulative time of use of the elastic body.

According to the present invention, by carrying out a preparatory process to polishing by dressing a polishing surface while supplying a polishing liquid (slurry) to the polishing surface, in place of the conventional polishing of a dummy wafer or the like, after a stand-by operation (idling), the cost of a dummy wafer or the like can be eliminated without making a design change, such as addition of a new device, for a polishing apparatus.

DETAILED DESCRIPTION OF THE INVENTION

Preferred embodiments of the present invention will now be described with reference to the drawings. The following description illustrates the case of polishing and flattening a surface (surface to be polished) of a substrate, such as a semiconductor wafer, as a workpiece.

Figure 1:
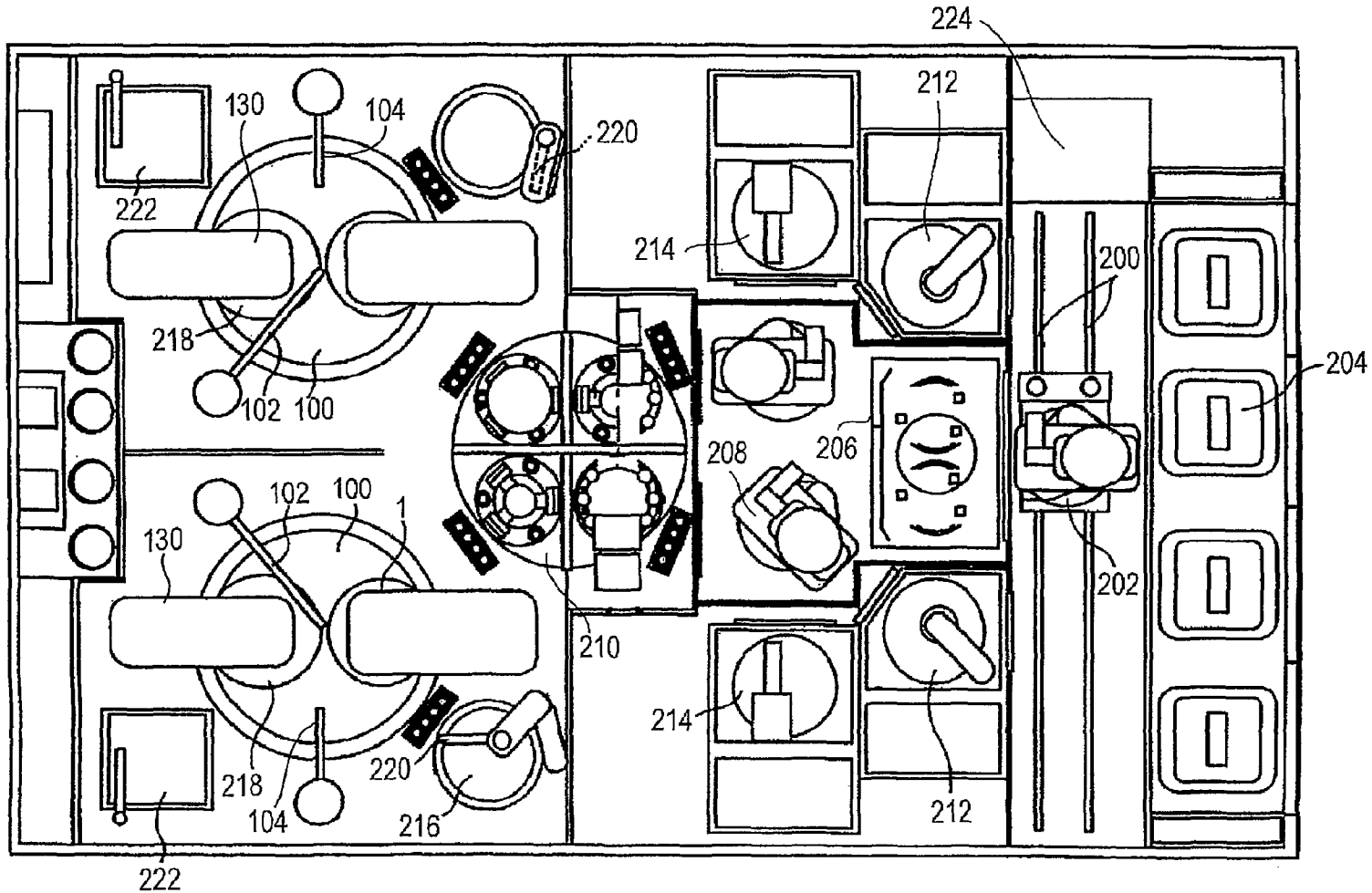
FIG. 1 is an overall layout plan view of a polishing apparatus according to an embodiment of the present invention.

FIG. 1 shows an overall layout plan view of a polishing apparatus according to an embodiment of the present invention. As shown in FIG. 1, in the polishing apparatus unpolished substrates (workpieces), such as semiconductor wafers, stocked in a cassette 204 are taken one by one by a transport robot 202, which moves on traveling rails 200, out of the cassette 204, and placed on a substrate stage 206. The unpolished substrate on the substrate stage 206 is transferred by a transport robot 208 onto a rotary transporter 210, while a polished substrate is transferred by the transport robot 208 from the rotary transporter 210 onto the substrate stage 206. The polished substrate on the substrate stage 206 is returned by the transport robot 202 into the cassette 204. The unpolished substrate on the rotary transporter 210 is held by the below-described top ring 1 and moved to a position on a polishing table 100 to carry out polishing of the substrate. The polishing apparatus is thus systematized so that a plurality of substrates can be polished successively on a lot basis.

The polishing apparatus includes cleaning machines 212, 214 for cleaning and drying a substrate after polishing, a polishing table 216 for carrying out a second-step polishing of a substrate surface, dressers 218, 220 for carrying out dressing of the polishing tables 100, 216, and a water tub 222 for cleaning the dresser 218. The polishing apparatus is designed to be capable of carrying out two or more multi-step polishing with one polishing table 100 by switching a plurality of polishing liquids or a plurality of polishing conditions (polishing recipes).

The polishing apparatus may be provided with four polishing tables so that each set of two polishing tables can be operated to carry out two-step polishing or the four tables can be operated to carry out four-step polishing.

The polishing apparatus is provided with an ITM (in-line thickness monitor) 224 as a measurement section for measuring the surface state, such as a thickness of a surface film, of a substrate before polishing, between processes during a multi-step polishing process, or after post-polishing, cleaning and drying. In particular, the ITM (measurement section) 224 is disposed at a location lying on a line extending from the traveling rails 200, as shown in FIG. 1. The ITM 224 measures a thickness of an insulating film such as an oxide film, or the polishing state of a conductive film such as a copper film or a barrier layer, of a substrate, such as a semiconductor wafer, using an optical means which emits light toward the substrate surface and receives an optical signal of the reflected light, before the transport robot 202 places the substrate after polishing into the cassette 204 or after the transport robot 202 takes the substrate before polishing out of the cassette 204.

Figure 2:
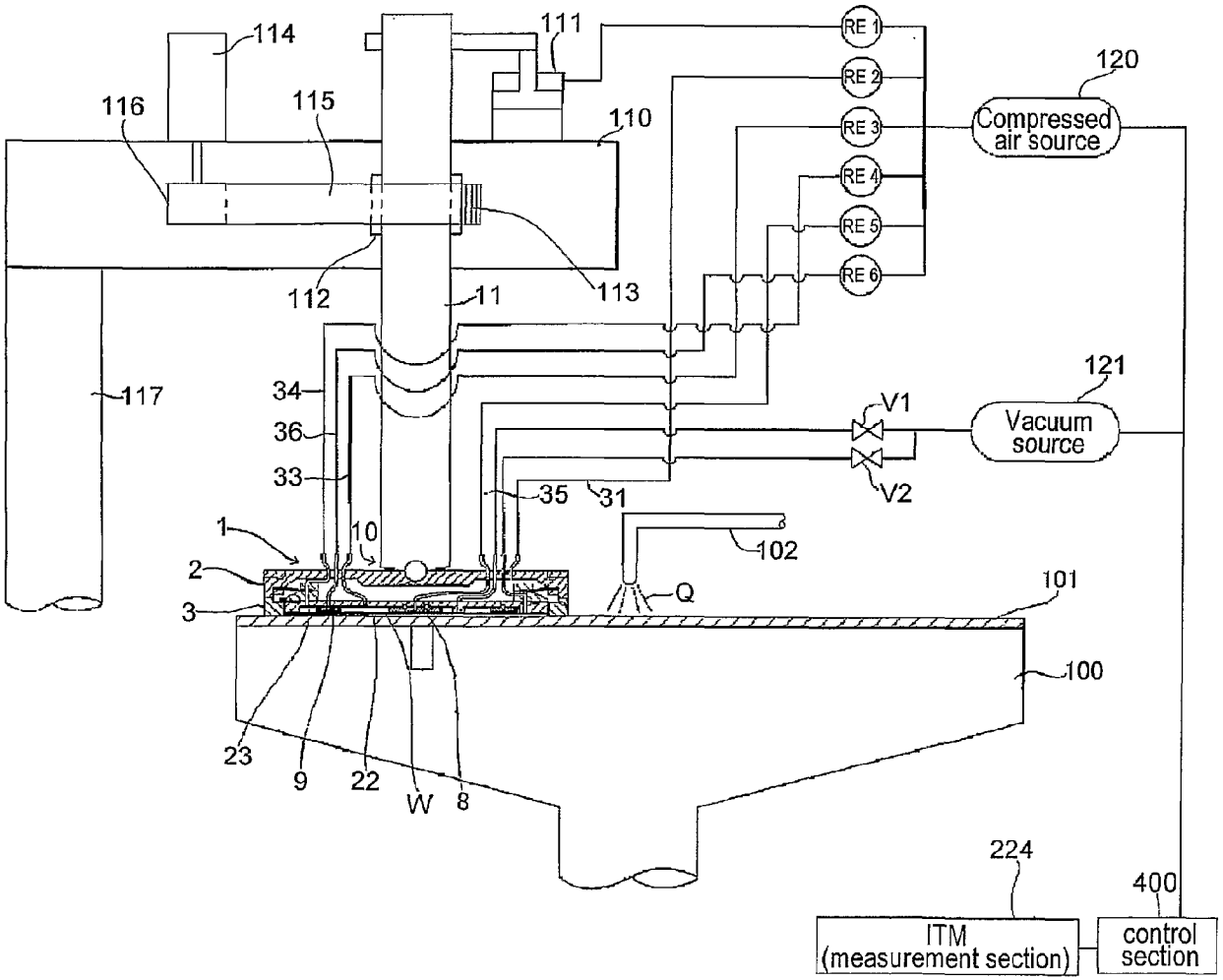
FIG. 2 is a schematic view of the polishing section of the polishing apparatus shown in FIG. 1.

The polishing section of the polishing apparatus holds a substrate such as a semiconductor wafer, a polishing object, and presses the substrate against a polishing surface over a polishing table, thereby flatly polishing the surface of the substrate. As shown in FIG. 2, below the top ring 1 is disposed a polishing table 100 to which is attached a polishing pad (polishing cloth) 101 having a polishing surface 101*a* (upper surface). Above the polishing table 100 is disposed a polishing liquid supply nozzle 102 which supplies a polishing liquid (slurry) Q onto the polishing pad 101 on the polishing table 100. The polishing section is thus constructed. Further, above the polishing table 100 is disposed a pure water supply nozzle 104 which supplies pure water onto the polishing pad 101 on the polishing table 100.

Various commercially-available polishing pads can be used as the polishing pad 101. Examples include SUBA800, IC-1000 and IC-1000/SUBA400 (two-layer cloth), manufactured by Rodel, Inc., and Surfin xxx-5 and Surfin 000, manufactured by Fujimi Incorporated. SUBA800, Surfin xxx-5 and Surfin 000 are non-woven fabrics each comprising fibers fixed with a polyurethane resin, and IC-1000 is a rigid foamed polyurethane (single layer). The foamed polyurethane is porous, having numerous fine recesses or holes in a surface. The polishing pad 101 basically is a consumable member, and gradually wears out as it polishes a surface of a substrate. In an actual polishing process, a polishing pad 101 is replaced with a new one when the polishing pad 101 has come to a predetermined thickness or the polishing rate becomes lower.

The top ring 1 is connected via a universal joint portion 10 to a top ring-driving shaft 11, and the top ring-driving shaft 11 is coupled to a top ring air cylinder 111 secured to a top ring head 110. The top ring-driving shaft 11 moves vertically by the top ring air cylinder 111, thereby moving up and down the entire top ring 1 and pressing a retainer ring 3, fixed to the lower end of a top ring body 2, against the polishing table 100. The top ring air cylinder 111 is connected via a regulator RE1 to a compressed air source 120. The pressure of pressurized air, supplied to the top ring air cylinder 111, can be regulated by the regulator RE1, whereby the pressure of the retainer ring 3 on the polishing pad 101 can be adjusted.

The top ring-driving shaft 11 is mounted via a key (not shown) to a rotating cylinder 112 which is provided with a timing pulley 113. A top ring motor 114 as a rotational drive section, which is provided with a timing pulley 116, is secured to a top ring head 110. The timing pulley 113 is connected to the timing pulley 116 via a timing belt 115. Thus, by rotationally driving the top ring motor 114, the rotating cylinder 112 and the top ring-driving shaft 11 rotate integrally by the timing pulley 116, the timing belt 115 and the timing pulley 113, whereby the top ring 1 rotates. The top ring head 110 is supported by a top ring head shaft 117 secured to a frame (not shown).

Though not depicted, the top ring motor 114 is provided with a torque sensor as a measurement section for measuring the torque of the motor 114. For example, when, during polishing of a substrate surface, a metal film on the substrate is removed and an insulating film, formed under the metal film, becomes exposed, the torque of the top ring motor 114 changes due to a change in the frictional force between the substrate surface and a polishing surface. The removal of the metal film can be determined by detecting the change with the torque sensor (measurement section). The torque sensor may either be one that actually measures the torque of a motor or one that measures the electric current of a motor. Though in this embodiment the torque sensor is provided in the top ring motor 114, it is also possible to provide a torque sensor as a measurement section in a polishing table motor for rotating the polishing table 100.

The dresser 218 is provided at the free end of a pivotable dresser head 130. Similarly to the top ring 1, the dresser 218 moves vertically by the actuation of an air cylinder (not shown) and rotates by a motor and timing pulleys (not shown).

Figure 3:
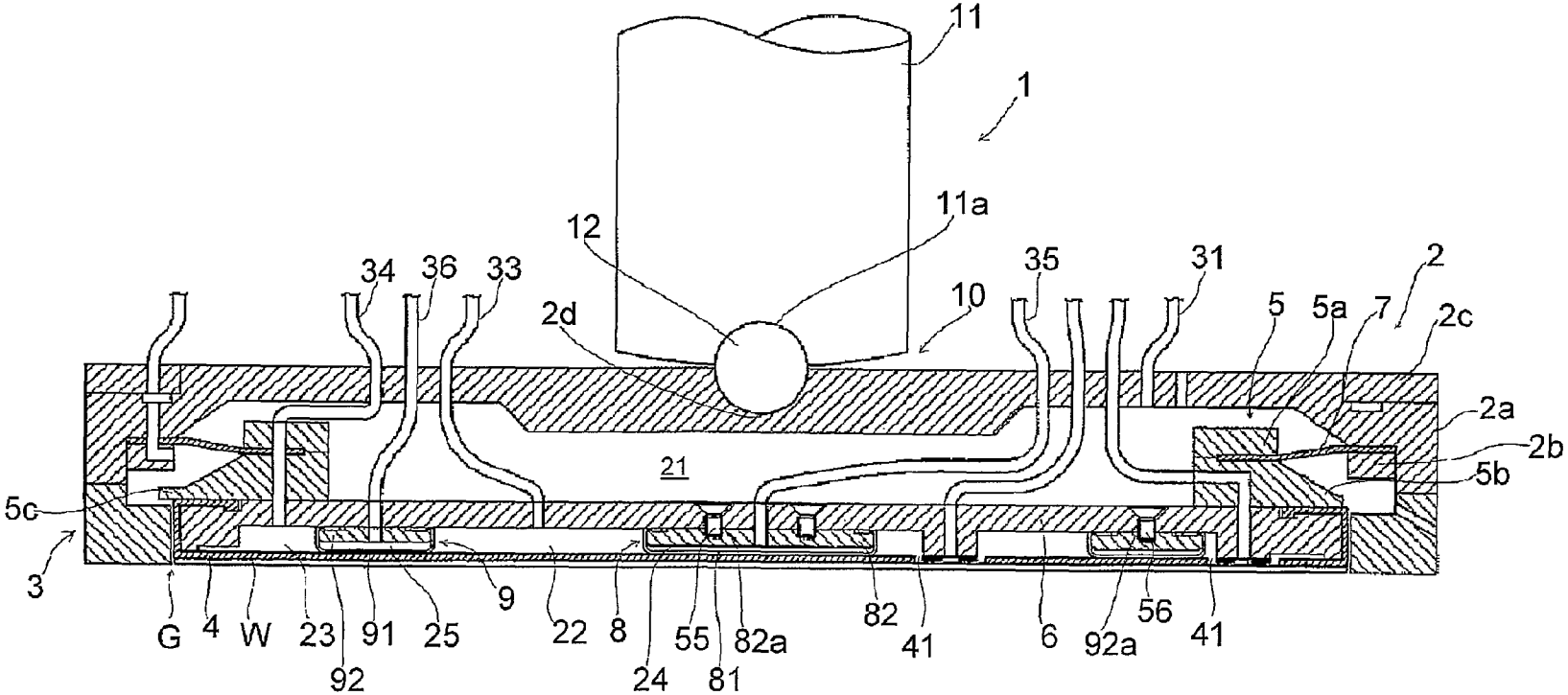
FIG. 3 is a vertical sectional view of the top ring of the polishing section shown in FIG. 2.
Figure 4:
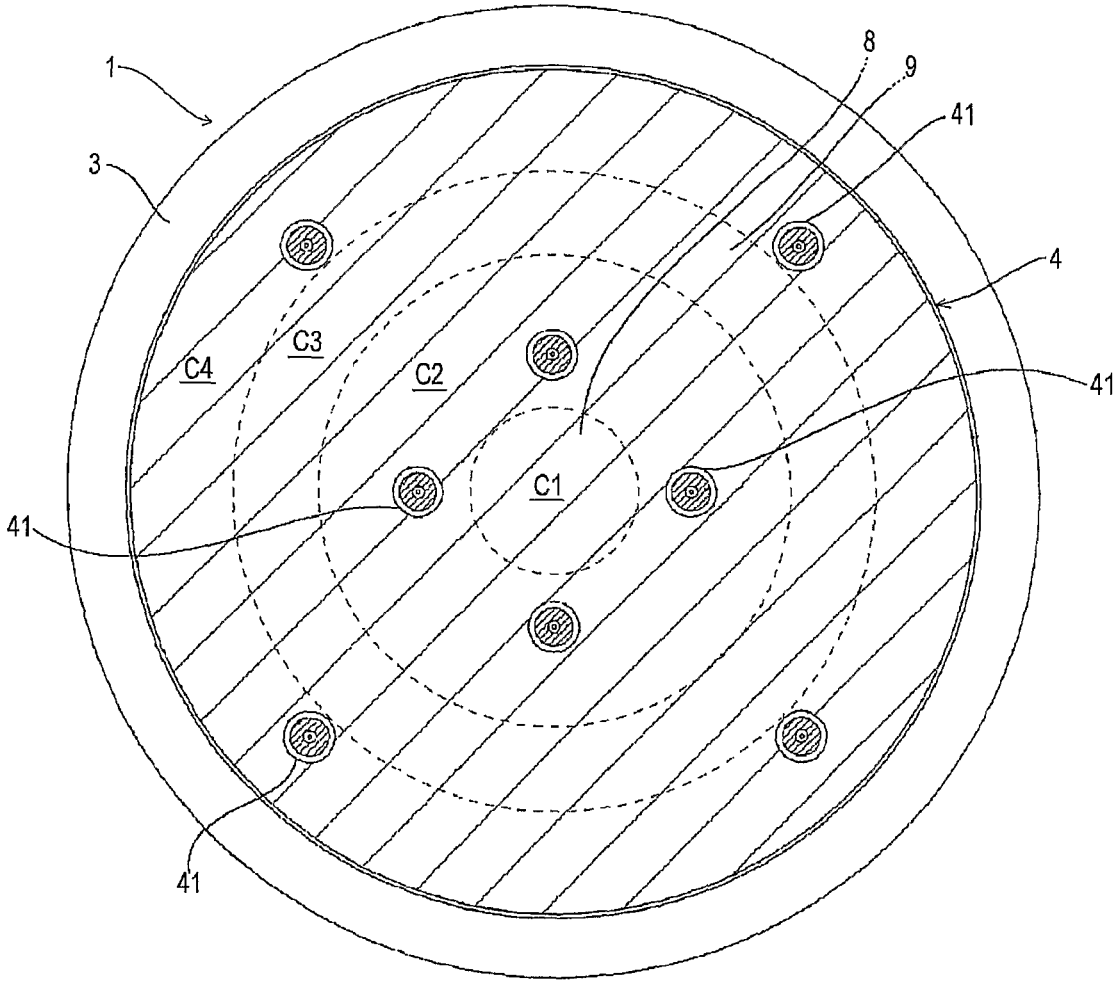
FIG. 4 is a bottom view of the top ring shown in FIG. 3.

The top ring 1 will now be described in more detail with reference to FIGS. 3 and 4. FIG. 3 is a vertical sectional view of the top ring 1, and FIG. 4 is a bottom view of the top ring 1 shown in FIG. 3.

As shown in FIG. 3, the top ring 1 includes a top ring body 2 in the shape of a cylindrical vessel having an internal space therein, and the retainer ring 3 fixed to the lower end of the top ring body 2. The top ring body 2 is formed of, for example, a material having high strength and high rigidity, such as a metal or a ceramic. The retainer ring 3 is formed of, for example, a resin having high rigidity or a ceramic.

The top ring body 2 includes a housing portion 2*a* in the shape of a cylindrical vessel, an annular pressure sheet support portion 2*b* fitted in the cylindrical portion of the housing portion 2*a*, and an annular sealing portion 2*c* fitted into a peripheral portion of the upper surface of the housing portion 2*a*. The lower portion of the retainer ring 3, fixed to the lower surface of the housing portion 2*a* of the top ring body 2, projects inwardly. The retainer ring 3 may be formed integrally with the top ring body 2.

The above-described top ring-drying shaft 11 is provided above the center of the housing portion 2*a* of the top ring body 2. The top ring body 2 and the top ring-driving shaft 11 are coupled by the universal joint portion 10. The universal joint portion 10 includes a spherical bearing mechanism which allows the top ring body 2 and the top ring-driving shaft 11 to tilt with respect to each other, and a rotation transmitting mechanism which transmits the rotation of the top ring-driving shaft 11 to the top ring body 2. Thus, the universal joint portion 10, while permitting tilting of the top ring body 2 with respect to the top ring-driving shaft 11, transmits the pressure and the torque of the top ring-driving shaft 11 to the top ring body 2.

The spherical bearing mechanism is comprised of a spherical recess 11*a* formed in the center of the lower surface of the top ring-driving shaft 11, a spherical recess 2*d* formed in the center of the upper surface of the housing portion 2*a*, and a bearing ball 12 of a high-hardness material, such as a ceramic, interposed between the recesses 11*a*, 2*d*. The rotation transmitting mechanism is comprised of a driving pin (not shown) fixed to the top ring-driving shaft 11, and a driven pin (not shown) fixed to the housing portion 2*a*. The driving pin and the driven pin are vertically movable relative to each other. Accordingly, even when the top ring body 2 is tilted, the pins still engage each other each at a shifted contact point. The rotation transmitting mechanism thus securely transmits the rotary torque of the top ring-driving shaft 1 to the top ring body 2.

In the interior space defined by the top ring body 2 and the retainer ring 3 fixed integrally to the top ring body 2, there are housed an elastic pad 4 to be in contact with a substrate W, such as a semiconductor wafer, held by the top ring 1, an annular holder ring 5, and a generally disk-shaped chucking plate 6 supporting the elastic pad 4. The elastic pad 4 is nipped, at its peripheral portion, between the holder ring 5 and the chucking plate 6 fixed to the lower end of the holder ring 5, and covers the lower surface of the chucking plate 6. A space is thus formed between the elastic pad 4 and the chucking plate 6.

A pressure sheet 7, composed of an elastic film, is stretched between the holder ring 5 and the top ring body 2. The pressure sheet 7 is fixed with its one end nipped between the housing portion 2*a* and the pressure sheet support portion 2*b* of the top ring body 2, and the other end nipped between an upper end portion 5*a* and a stopper portion 5*b* of the holder ring 5. A pressure chamber 21 is formed inside the top ring body 2 by the top ring body 2, the chucking plate 6, the holder ring 5 and the pressure sheet 7. As shown in FIG. 3, a fluid passage 31, e.g., comprised of a tube and a connector, communicates with the pressure chamber 21. The pressure chamber 21 is connected to the compressed air source 120 via a regulator RE2 provided in the fluid passage 31. The pressure sheet 7 is formed of, for example, a rubber material having excellent strength and durability, such as ethylene-propylene rubber (EPDM), polyurethane rubber, or silicon rubber.

In case the pressure sheet 7 is formed of an elastic material, such as a rubber, and is fixed by nipping it between the retainer ring 3 and the top ring body 2, because of the elastic deformation of the elastic pressure sheet 7, a desirable flat plane may not be obtained in the lower surface of the retainer ring 3. In view of this, the pressure sheet support portion 2*b* is separately provided, according to this embodiment, so as to nip and fix the pressure sheet 7 between the housing portion 2*a* and the pressure sheet support portion 2*b* of the top ring body 2.

It is also possible to make the retainer ring 3 vertically movable relative to the top ring-body 2 or to make the retainer ring 3 pressable independent of the top ring body 2, as disclosed in Japanese Patent Application No. H8-50956 (Laid-Open Publication No. H9-168964) or Japanese Patent Application No. H11-294503. In such a case, the above-described fixing method for the pressure sheet 7 may not necessarily be employed.

A center bag 8 (central contact member) and a ring tube 9 (outer contact member), which are contact members to be in contact with the elastic pad 4, are provided in the space formed between the elastic pad 4 and the chucking plate 6. As shown in FIGS. 3 and 4, in this embodiment, the center bag 8 is disposed in the center of the lower surface of the chucking plate 6, and the ring tube 9 is disposed outside of the center bag 8 such that it surrounds the center bag 8. As with the pressure sheet 7, the elastic pad 4, the center bag 8 and the ring tube 9 are formed of, for example, a rubber material having excellent strength and durability, such as ethylene-propylene rubber (EPDM), polyurethane rubber, or silicon rubber.

The space formed between the chucking plate 6 and the elastic pad 4 is divided by the center bag 8 and the ring tube 9 into the following chambers: a pressure chamber 22 formed between the center bag 8 and the ring tube 9; and a pressure chamber 23 formed outside the ring tube 9.

The center bag 8 is comprised of an elastic film 81, which is in contact with the upper surface of the elastic pad 4, and a center bag holder 82 (holding portion) detachably holding the elastic film 81. The center bag holder 82 has screw holes 82*a*, and the center bag 8 is detachably mounted to the center of the lower surface of the chucking plate 6 by screwing screws 55 into the screw holes 82*a*. The center bag 8 internally has a central pressure chamber 24 defined by the elastic film 81 and the center bag holder 82.

Similarly, the ring tube 9 is comprised of an elastic film 91, which is in contact with the upper surface of the elastic pad 4, and a ring tube holder 92 (holding portion) detachably holding the elastic film 91. The ring tube holder 92 has screw holes 92*a*, and the ring tube 9 is detachably mounted to the lower surface of the chucking plate 6 by screwing screws 56 into the screw holes 92*a*. The ring tube 9 internally has an intermediate pressure chamber 25 defined by the elastic film 91 and the ring tube holder 92.

Fluid passages 33, 34, 35, 36, each comprised of, e.g., a tube and a connector, communicate with the pressure chambers 22, 23, the central pressure chamber 24 and the intermediate pressure chamber 25, respectively. The pressure chambers 22-25 are connected to the compressed air source 120 as a supply source via regulators RE3, RE4, RE5, RE6 respectively provided in the fluid passages 33-36. The fluid passages 31, 33-36 are connected to the respective regulators RE2-RE6 via rotary joints (not shown) provided at the upper end of the top ring-driving shaft 11.

A pressurized fluid, such as pressurized air, or atmospheric pressure or vacuum is supplied to the above-described pressure chamber 21, lying over the chucking plate 6, and to the pressure chambers 22-25 through the fluid passages 31, 33-36 communicating with the pressure chambers. As shown in FIG. 2, the pressures of pressurized fluids to be supplied to the pressure chambers 21-25 can be adjusted by the regulators RE2-RE6 provided in the fluid passages 31, 33-36 for the pressure chambers 21-25. The pressures in the pressure chambers 21-25 can thus be controlled independently or can be brought to atmospheric pressure or vacuum.

By thus making the pressures in the pressure chambers 21-25 independently variable by the regulators RE2-RE6, it becomes possible to adjust the pressure of the elastic pad 4 on the substrate W, and thus the pressure of the substrate W on the polishing pad 4, independently for divisional portions (divisional areas) of the substrate W. In some cases, the pressure chambers 21-25 may be connected to a vacuum source 121.

The operation of the top ring 1 having the above construction upon polishing will now be described. When carrying out polishing of a substrate W, the substrate W is held on the lower surface of the top ring 1 while the top ring air cylinder 111, coupled to the top ring-driving shaft 11, is actuated to press the retainer ring 3, fixed to the lower end of the top ring 1, against the polishing surface 101*a* of the polishing pad 101 of the polishing table 100 at a predetermined pressure. Pressurized fluids at predetermined pressures are respectively supplied to the pressure chambers 22, 23, the central pressure chamber 24 and the intermediate pressure chamber 25 to press the substrate W against the polishing surface 101*a* of the polishing pad 101 of the polishing table 100. A polishing liquid Q is supplied from the polishing liquid supply nozzle 102 onto the polishing pad 161, and the polishing liquid Q is held on the polishing pad 101. Polishing of the lower surface of the substrate W is thus carried out with the polishing liquid Q present between the to-be-polished surface (lower surface) of the substrate W and the polishing surface 101*a* of the polishing pad 101.

The portions of the substrate W, which lie underneath the pressure chambers 22, 23, are pressed against a polishing surface 101*a* by the pressures of pressurized fluids respectively supplied to the pressure chambers 22, 23. The portion of the substrate W, which lies underneath the central pressure chamber 24, is pressed against the polishing surface 101*a*, via the elastic film 81 of the center bag 8 and the elastic pad 4, by the pressure of a pressurized fluid supplied to the central pressure chamber 24. The portion of the substrate W, which lies underneath the intermediate pressure chamber 25, is pressed against the polishing surface 101*a*, via the elastic film 91 of the ring tube 9 and the elastic pad 4, by the pressure of a pressurized fluid supplied to the intermediate pressure chamber 25.

Accordingly, the polishing pressure applied to the substrate W can be adjusted individually for the divisional portions, divided along the radial direction, of the substrate W by controlling the pressures of pressurized fluids respectively supplied to the pressure chambers 22-25. In particular, a control section (controller) 400 controls the pressures of pressurized fluids, respectively supplied to the pressure chambers 22-25, independently by the regulators RE3-RE6, thereby adjusting the pressures of the substrate W on the polishing pad 101 of the polishing table 100 independently for the divisional portions of the substrate W. The substrate W can thus be pressed against the polishing pad 101 on the upper surface of the rotating polishing table 100 with the polishing pressure adjusted to a desired value for each divisional portion of the substrate W. Similarly, the pressure of a pressurized fluid supplied to the top ring air cylinder 111 can be adjusted by the regulator RE1 so as to change the pressure of the retainer ring 3 on the polishing pad 101.

By thus appropriately adjusting, during polishing, the pressure of the retainer ring 3 on the polishing pad 101 and the pressure of the substrate W on the polishing pad 101, a desired distribution of polishing pressure can be obtained over the center portion of the substrate W (portion C1 shown in FIG. 4), the center to intermediate portion (C2), the intermediate portion (C3) and the peripheral portion (C4), and the retainer ring 3 lying outside the substrate W.

In the portions of the substrate W which lie underneath the pressure chambers 22, 23, there are a portion to which a pressure is applied via the elastic pad 4 from a pressurized fluid and a portion, such as a portion corresponding to an opening 41, to which the pressure of the pressurized fluid is directly applied. The pressures applied to these portions may be equal or different from each other. The elastic pad 4 around an opening 41 adheres tightly to the back surface of the substrate W during polishing. Therefore, the pressurized fluids in the pressure chambers 22, 23 seldom leak out.

The substrate W can thus be divided into four concentric circular and annular portions (C1-C4), and those portions (areas) can be pressed at independent pressures. The polishing rate depends on the pressure of the substrate W on a polishing surface and, as described above, the pressure of each divisional portion of the substrate W can be controlled independently. It thus becomes possible to independently control the polishing rates of the four portions (C1-C4) of the substrate W. Accordingly, even when there is a radial variation in a thickness of a to-be-polished surface film of the substrate W, shortage of polishing or over-polishing can be avoided over the entire substrate surface.

In particular, even when a thickness of a to-be-polished surface film of the substrate W varies in the radial direction of the substrate W, the pressure of a portion of the substrate W, having a relatively large film thickness, on a polishing surface can be made higher than the pressure of a portion of the substrate W, having a relatively small film thickness, on the polishing surface by making the pressures of those pressure chambers of the pressure chambers 22-25, which lie over the portion of the substrate W having a relatively large film thickness, higher than the pressures of the other pressure chambers, or by making the pressures of those pressure chambers, which lie over the portion of the substrate W having a relatively small film thickness, lower than the pressures of the other pressure chambers. The polishing rate of the portion of the substrate W having a relatively large film thickness can thus be selectively raised. This makes it possible to polish the surface of the substrate W without excess or shortage of polishing over the entire surface irrespective of the thickness distribution of a surface film upon its formation.

The phenomenon of over-polishing of edge, which can occur in the edge portion of the substrate W, can be prevented by controlling the pressure of the retainer ring 3. Further, when there is a large change in a thickness of a to-be-polished film in the edge portion of the substrate W, the polishing rate of the edge portion of the substrate W can be controlled by making the pressure of the retainer ring 3 high or low intentionally. When pressurized fluids are supplied to the pressure chambers 22-25, the chucking plate 6 receives an upward force. According to this embodiment, a pressurized fluid is supplied through the fluid passage 31 into the pressure chamber 21 to prevent the chucking plate 6 from being lifted up by the force applied from the pressure chambers 22-25.

Polishing of the substrate W is thus carried out while appropriately adjusting the pressure of the retainer ring 3 on the polishing pad 101 by the top ring air cylinder 111 and the pressures of the divisional portions of the substrate W on the polishing pad 101 with pressurized airs supplied to the pressure chambers 22-25, as described above.

As described hereinabove, the pressure on a substrate can be controlled by independently controlling the pressures in the pressure chambers 22, 23, the pressure chamber 24 in the center bag 8, and the pressure chamber 25 in the ring tube 9. Further according to this embodiment, a particular area of a substrate, for which pressure control is carried out, can be easily changed by changing the position, size, etc. of the center bag 8 or the ring tube 9.

In particular, a thickness distribution of a film formed on a surface of a substrate may vary depending on the film-forming method, the type of the film-forming apparatus used, and the like. According to this embodiment, the position and the size of a pressure chamber for applying a pressure on a substrate can be changed simply by changing the center bag 8 and the center bag holder 82, or the ring tube 9 and the ring tube holder 92. Thus, a region of a substrate to carry out pressure control can be changed according to a thickness distribution of a to-be-polished film easily at a low cost simply by changing only a part of the top ring 1. This makes it possible to deal with a change in a thickness distribution of a to-be-polished surface film of a substrate easily at a low cost. It is to be noted that changing the shape and the position of the center bag 8 or the ring tube 9 should necessarily change the size of the pressure chamber 22, lying between the center bag 8 and the ring tube 9, and the size of the pressure chamber 23 surrounding the ring tube 9.

On a substrate as a polishing object by this polishing apparatus is formed, for example, a copper plated film for forming interconnects, and a barrier layer underlying the plated film. When an insulating film of, e.g., silicon oxide is formed as the topmost layer of a substrate as a polishing object by this polishing apparatus, a thickness of the insulating film can be detected with an optical sensor or a microwave sensor. A halogen lamp, a xenon flash lamp, an LED or a laser light source can be used as the light source of the optical sensor.

The polishing surface (front surface) 101*a* of the polishing pad 101 has a certain roughness so that a surface of a substrate, such as a semiconductor wafer, can be polished. With the progress of polishing, however, the roughness of the polishing surface 101*a* of the polishing pad 101 decreases and, therefore, the polishing performance becomes lowered. Dressing of the polishing surface 101*a* of the polishing pad 101 is therefore carried out between polishing operations, i.e., after polishing of one substrate and before polishing of the next substrate. The dressing is carried out for dressing of the polishing surface 101*a* of the polishing pad 101 and cleaning of the polishing pad 101.

In particular, the dresser 218 in a retreat position is moved horizontally to a predetermined position above the polishing table 100. The dresser 218 is then lowered so as to press the lower surface (dressing surface) of the dresser 218 against the polishing surface 101*a* of the polishing pad 101 at a predetermined pressure. At the same time, the dresser 218 and the polishing table 100 are rotated while supplying pure water from the pure water supply nozzle 104 to the polishing pad 101, thereby carrying out dressing with the dresser 218 of the polishing surface 101*a* of the polishing pad 101. After completion of the dressing, the rotations of the dresser 218 and the polishing table 100, and the supply of pure water from the pure water supply nozzle 104 are stopped, and the dresser 218 is raised and then returned to the retreat position.

Polishing by the polishing apparatus is carried out on a lot basis. Thus, after the completion of polishing of all the substrates W housed in the cassette 204 loaded in the polishing apparatus, the cassette 204 is taken out of the polishing apparatus and transported to the next-process apparatus. A new cassette 204 is then loaded into the polishing apparatus, and polishing of the substrates W housed in the new cassette 204 is resumed. During the period from the completion of the previous polishing until the resumption of the next polishing, the polishing apparatus enters into the state of stand-by operation (idling) in preparation for the next polishing.

Figure 5:
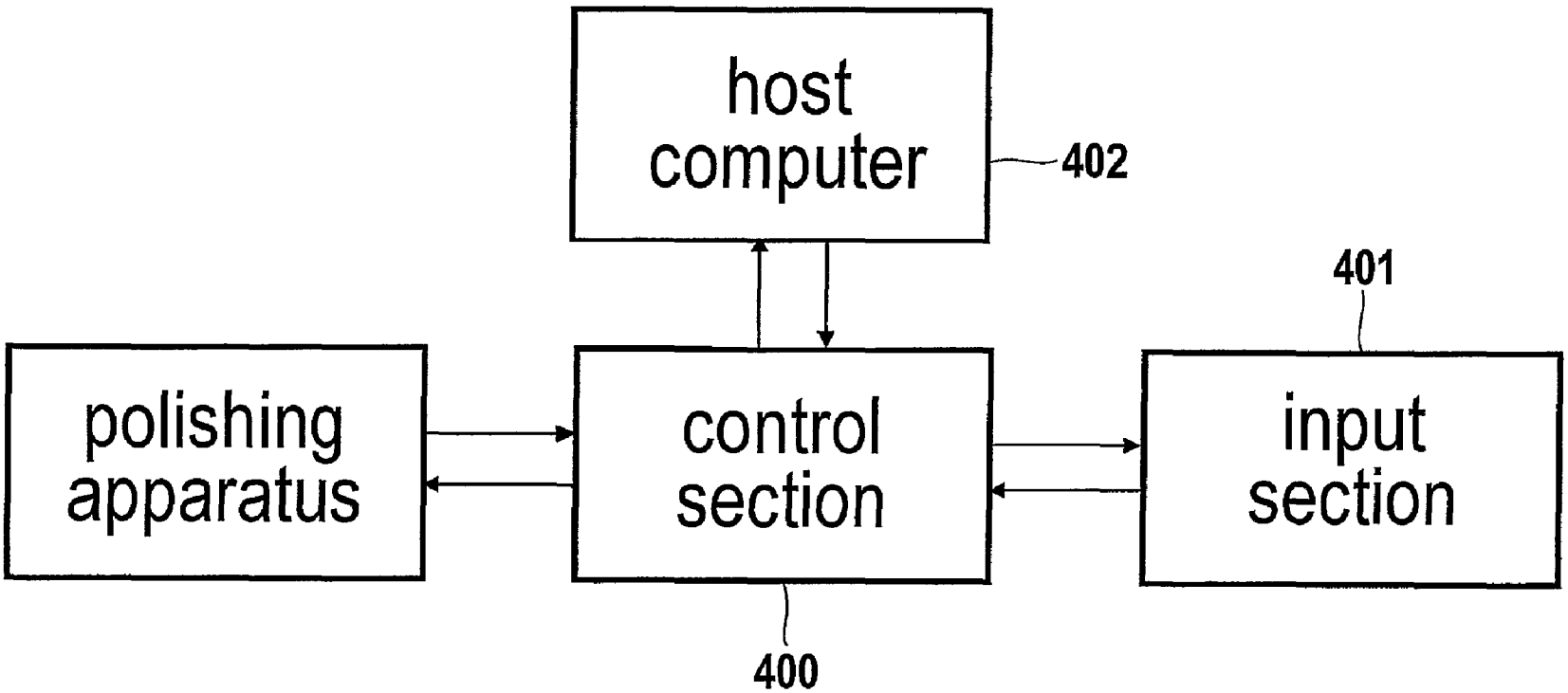
FIG. 5 is a control block diagram of the polishing apparatus.

In this embodiment, as shown in FIG. 5, the control section 400 controls the polishing apparatus, based on an input from an input section 401, such as an operation panel, and an input from a host computer 402 that performs various data processings, in the following manner.

When the polishing apparatus has entered into the state of stand-by operation, pure water is supplied from the pure water supply nozzle 104 to the polishing pad 101 while rotating the polishing table 100, thereby preventing drying of the polishing pad 101. When a cassette 204 is loaded into the polishing apparatus after the stand-by operation, by the control section 400 in the polishing apparatus, the supply of pure water from the pure water supply nozzle 104 is stopped, while the supply of a polishing liquid (slurry) Q from the polishing liquid supply nozzle 102 is started and, at the same time, the dresser 218 and the polishing table 100 are rotated while pressing the dresser 218 against the polishing surface 101*a* of the polishing pad 101. A preparatory process to polishing (pre-polishing dressing process), comprising dressing of the polishing surface 101*a* of the polishing pad 101, is thus carried out. The time of the preparatory process to polishing is, for example, inputted by the operator via the input section 401 provided in the control section 400. After completion of the preparatory process to polishing, substrates W are taken one by one out of the cassette 204 and polishing of the substrates W is started.

By thus carrying out, after the completion of stand-by operation and before the start of polishing of a substrate W, a preparatory process to polishing by dressing the polishing surface 101*a* of the polishing pad 101 while supplying the polishing liquid Q to the polishing surface 101*a*, it becomes possible to bring the polishing surface 101*a* to a desired temperature and wet the polishing pad 101 with the polishing liquid Q, thereby bringing the polishing surface 101*a* to the optimum condition for polishing, without using a dummy wafer or the like. This can eliminate the cost of a dummy wafer or the like without making a design change, such as addition of a new device, for the polishing apparatus. It is also possible to measure the surface temperature/distribution of the polishing surface 101*a* by a not-shown radiation thermometer, compare the measurement results with a desired surface temperature/distribution and control the above-described preparatory process to polishing (pre-polishing dressing process) so that the polishing surface 101*a* is brought to the desired surface temperature/distribution.

In this embodiment, the control section 400 is set to make a decision as to whether or not to carry out the preparatory process to polishing after completion of the stand-by operation based on the total operating time of stand-by operation or the total effective number of stand-by operations. It is not necessary to carry out the preparatory process to polishing every time after completion of the stand-by operation. By making determination as to whether or not to carry out the preparatory process to polishing based on the total operating time of stand-by operation or the total effective number of stand-by operations, it becomes possible to carry out the preparatory process to polishing only when it is needed. It is also possible to make a decision as to whether not to carry out the preparatory process to polishing based on the results of the above-described measurement of the surface temperature/distribution of the polishing surface 101*a*.

A program stored in the control section 400 sets operating conditions concerning stand-by operation (idling operation), preparatory process to polishing (pre-polishing dressing process) and substrate polishing process based on parameters inputted from the input section 401, and operates the polishing apparatus.

An operation is also set to dress the polishing surface 101*a* of the polishing pad 101 during the stand-by operation. In particular, during the stand-by operation, the dresser 218 is pressed against the polishing surface 101*a* while rotating the dresser 218 and the polishing table 100, and supplying pure water from the pure water supply nozzle 104 to the polishing pad 101.

As polishing progresses, the roughness of the polishing surface 101*a* of the polishing pad 101 decreases and the polishing performance lowers. In order to restore the roughness of the polishing surface 101*a* of the polishing pad 100, therefore, dressing of the polishing surface 101*a* is carried out, between polishing operations, by bringing the dresser 218 into contact with the polishing surface 101*a* while rotating the dresser 218 and the polishing surface 101*a* relative to each other, as described above. However, in case the polishing pad 101 is used over a long period of time, sufficient dressing of the polishing surface 101*a* may not be achieved by a predetermined time of dressing process, thus failing in obtaining a sufficient roughness. In such a case, it will be necessary to replace the polishing pad 101 with a new one even before using up the polishing pad 101. By carrying out the additional dressing of the polishing surface 101*a* of the polishing pad 101 with pure water during the stand-by operation, according to this embodiment, it becomes possible to achieve sufficient dressing of the polishing surface 101*a*, thereby extending the life of the polishing pad 101.

An operation is also set to internally apply a gas pressure to the hermetically-closed pressure chambers 24, 25 of the top ring 1 during the stand-by operation, thereby pressurizing the pressure chambers 24, 25. The elastic pad 4 covering the other pressure chambers 22, 23 has the openings 41 at predetermined positions. Since the pressure chambers 22, 23 are thus not hermetically sealed, it is not possible to pressurize the pressure chambers 22, 23 by applying a gas pressure to these chambers 22, 23 during the stand-by operation.

The elastic films 81, 91 and the elastic pad 4, which are formed of an elastic material, such as a rubber, and expand/contract when pressurizing the pressure chambers 24, of the top ring 1 by applying a gas pressure to the pressure chambers 24, 25, become gradually hardened (deteriorated) with time. Accordingly, in the case of polishing a plurality of lots of substrates, a desired pressure on a substrate may not be obtained for substrates of a later lot because of shortage of expansion/contraction of the elastic films 81, 91 and the elastic pad 4 which have become hardened, even when the same gas pressure as applied to the pressure chambers 24, 25 upon polishing of substrates of an early lot is applied to the chambers 24, 25 upon polishing of the substrates of the later lot.

The hardening of the elastic films 81, 91 and the elastic pad 4 can be prevented by applying a gas pressure to the hermetically-closed chambers 24, 25 of the top ring 1 during the preparatory process to polishing, according to this embodiment.

The control section 400 of the polishing apparatus is capable of setting the above operations during the stand-by operation. Based on the parameters inputted via the input section 401, the program in the control section 400 determines the operating conditions of the polishing apparatus during the stand-by operation. Dressing of the polishing surface 101*a* of the polishing pad 101 during the stand-by operation often becomes necessary after some use of the polishing pad 101. Determination as to whether or not to carry out dressing of the polishing surface 101*a* of the polishing pad 101 may therefore be made on the basis of the total time of use of the polishing pad 101. Pressurization of the pressure chambers 24, 25 of the top ring 1 during the stand-by operation often becomes necessary after some use of the elastic films 81, 91 and the elastic pad 4 which expand/contract when pressurizing the pressure chambers 24, 25. Pressurization conditions for the pressure chambers 24, 25 may therefore be determined on the basis of the total time of use of the elastic films 81, 91 and the elastic pad 4.

Figure 6:
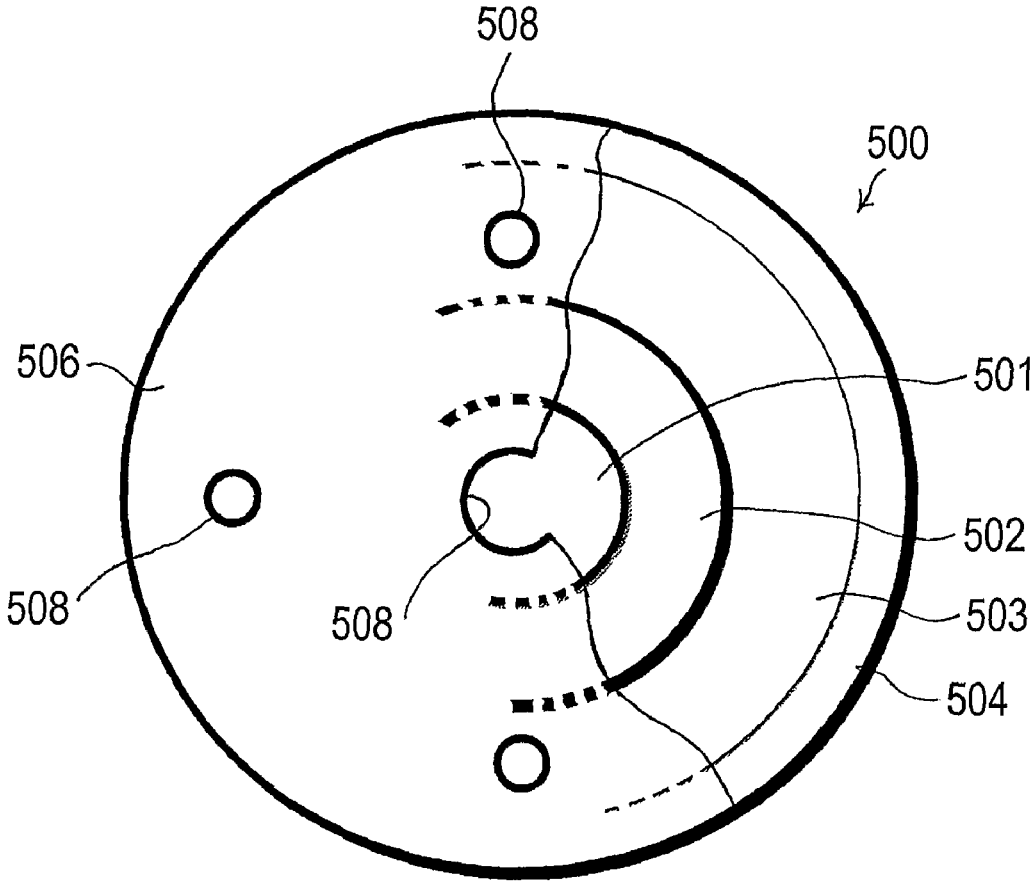
FIG. 6 is a bottom view, partly broken away, of another top ring.

FIG. 6 shows a bottom view of another top ring 500. The top ring 500 has four concentric pressure chambers: a center area pressure chamber 501; a ripple area pressure chamber 502; an outer area pressure chamber 503; and an edge area pressure chamber 504. The pressure chambers 501-504 are integrally covered with an elastic pad (elastic body) 506. Openings 508 for attracting a substrate are provided at predetermined positions in the elastic pad 506 covering the center area chamber 501 and the outer area chamber 503.

According to this top ring 500, the ripple area chamber 502 and the edge area chamber 504 are hermetically closed, and these chambers 502, 504 are pressurized by applying a gas pressure thereto during a stand-by operation.

INDUSTRIAL APPLICABILITY

The present invention is useful for polishing and flattening a surface of a substrate, such as a semiconductor wafer.

The invention claimed is:

1. A polishing method comprising:

performing a stand-by operation by pressurizing a pressure chamber of a top ring, which is not holding anything, so as to forcibly contract/expand an elastic body of the top ring, the top ring to press a workpiece against a polishing surface of a polishing table during polishing;

performing a preparatory process to polishing, after completion of the stand-by operation, by pressing a dresser against the polishing surface while supplying a polishing liquid to the polishing surface and rotating the polishing table so as to dress the polishing surface; and starting polishing of workpieces after completion of the preparatory process to polishing.

2. The polishing method according to claim 1, further comprising supplying pure water to the polishing surface during the stand-by operation.

3. The polishing method according to claim 1, further comprising performing dressing of the polishing surface during the stand-by operation.

4. The polishing method according to claim 1, wherein the stand-by operation is performed after completion of polishing of all workpieces housed in a cassette loaded in a polishing apparatus until a new cassette housing unpolished workpieces is loaded in the polishing apparatus.

5. A polishing method comprising:

performing a stand-by operation by pressurizing a pressure chamber of a top ring, which is not holding anything, so as to forcibly contract/expand an elastic body of the top ring, the top ring to press a workpiece against a polishing surface of a polishing table during polishing;

deciding whether or not to perform a preparatory process to polishing after completion of the stand-by operation based on a total operating time of the stand-by operation or a total effective number of times the stand-by operation is performed;

if it is decided that the preparatory process to polishing is to be performed, performing the preparatory process to polishing, after completion of the stand-by operation, by pressing a dresser against the polishing surface while supplying a polishing liquid to the polishing surface and rotating the polishing table so as to dress the polishing surface; and starting polishing of workpieces after completion of the preparatory process to polishing or if it is decided that the preparatory process to polishing is not to be performed.

6. A polishing apparatus comprising:

a polishing table having a polishing surface;

a top ring for holding a workpiece and pressing the workpiece against the polishing surface, the top ring having a pressure chamber and an elastic body which is to press the workpiece against the polishing surface of the polishing table during polishing;

a dresser for dressing the polishing surface;

a polishing liquid supply nozzle for supplying a polishing liquid to the polishing surface; and a control section for controlling the polishing table, the top ring, the polishing liquid supply nozzle and the dresser to perform a preparatory process to polishing by pressing the dresser against the polishing surface while supplying the polishing liquid to the polishing surface and rotating the polishing table so as to dress the polishing surface, after completion of a stand-by operation, which is carried out by pressurizing the pressure chamber of the top ring, which is not holding anything, so as to forcibly contract/expand the elastic body of the top ring.

7. A polishing apparatus comprising:

a polishing table having a polishing surface;

a top ring for holding a workpiece and pressing the workpiece against the polishing surface, the top ring having a pressure chamber and an elastic body which is to press the workpiece against the polishing surface of the polishing table during polishing;

a dresser for dressing the polishing surface;

a polishing liquid supply nozzle for supplying a polishing liquid to the polishing surface; and a control section for deciding whether or not to perform a preparatory process to polishing based on a total operating time of a stand-by operation or a total effective number of times the stand-by operation is performed, and if it is decided to perform the preparatory process to polishing, controlling the polishing table, the top ring, the polishing liquid supply nozzle and the dresser to perform the preparatory process to polishing by pressing the dresser against the polishing surface while supplying the polishing liquid to the polishing surface and rotating the polishing table so as to dress the polishing surface, after completion of the stand-by operation, wherein the control section controls performance of the stand-by operation by pressurizing the pressure chamber of the top ring, which is not holding anything, so as to forcibly contract/ex and the elastic body of the top ring.

8. A non-transitory storage medium that stores a program for controlling a polishing apparatus to perform a method comprising:

performing a stand-by operation by pressurizing a pressure chamber of a top ring, which is not holding anything, so as to forcibly contract/expand an elastic body of the top ring, the top ring to press a workpiece against a polishing surface of a polishing table during polishing;

performing a preparatory process to polishing, after completion of the stand-by operation, by pressing a dresser against the polishing surface while supplying a polishing liquid to the polishing surface and rotating the polishing table so as to dress the polishing surface; and starting polishing of workpieces after completion of the preparatory process to polishing.

9. The non-transitory storage medium that stores the program for controlling the polishing apparatus to perform the method according to claim 8, the method further comprising:

deciding whether or not to perform dressing of the polishing surface during the stand-by operation based on a cumulative time of use of the polishing surface; and if it is decided that the dressing of the polishing surface is to be performed, dressing the polishing surface during the stand-by operation.

10. A non-transitory storage medium that stores a program for controlling a polishing apparatus to perform a method comprising:

performing a stand-by operation by pressurizing a pressure chamber of a top ring, which is not holding anything, so as to forcibly contract/expand an elastic body of the top ring, the top ring to press a workpiece against a polishing surface of a polishing table during polishing;

deciding whether or not to perform a preparatory process to polishing after completion of the stand-by operation based on a total operating time of the stand-by operation or a total effective number of times the stand-by operation is performed;

if it is decided that the preparatory process to polishing is to be performed, performing the preparatory process to polishing, after completion of the stand-by operation, by pressing a dresser against the polishing surface while supplying a polishing liquid to the polishing surface and rotating the polishing table so as to dress the polishing surface; and starting polishing of workpieces after completion of the preparatory process to polishing or if it is decided that the preparatory process to polishing is not to be performed.

11. A non-transitory storage medium that stores a program for controlling a polishing apparatus to perform a method comprising:

deciding whether or not to pressurize, during a stand-by operation, a pressure chamber of a top ring, which is not holding anything, so as to forcibly contract/expand an elastic body of the top ring, the top ring to press a workpiece against a polishing surface of a polishing table during polishing;

performing the stand-by operation, the stand-by operation including pressurizing the pressure chamber of the top ring if it is decided that the pressure chamber is to be pressurized;

performing a preparatory process to polishing, after completion of the stand-by operation, by pressing a dresser against the polishing surface while supplying a polishing liquid to the polishing surface and rotating the polishing table so as to dress the polishing surface; and starting polishing of workpieces after completion of the preparatory process to polishing.

* * * * *